US008505720B2

(12) United States Patent
Huang

(10) Patent No.: US 8,505,720 B2
(45) Date of Patent: Aug. 13, 2013

(54) TOOL POSITIONING PAD

(71) Applicant: Kevin Huang, Taichung (TW)

(72) Inventor: Kevin Huang, Taichung (TW)

( * ) Notice: Subject to any disclaimer, the term of this patent is extended or adjusted under 35 U.S.C. 154(b) by 0 days.

(21) Appl. No.: 13/733,899

(22) Filed: Jan. 4, 2013

(65) Prior Publication Data

US 2013/0118938 A1 May 16, 2013

Related U.S. Application Data

(63) Continuation-in-part of application No. 13/208,351, filed on Aug. 12, 2011, now Pat. No. 8,371,444.

(51) Int. Cl.
*B65D 85/28* (2006.01)

(52) U.S. Cl.
USPC ..... 206/373; 206/34; 206/377; 206/378; 211/69; 211/70.6

(58) Field of Classification Search
USPC ..... 206/372–379, 477, 482, 486; 211/69, 211/70.6; 248/65, 73, 74.1, 309.1, 311.2, 248/313, 316.1, 316.7
See application file for complete search history.

(56) References Cited

U.S. PATENT DOCUMENTS

| | | | | |
|---|---|---|---|---|
| 4,154,795 | A * | 5/1979 | Thorne | 206/562 |
| 6,209,827 | B1 * | 4/2001 | Kawai | 248/73 |
| 6,286,678 | B1 * | 9/2001 | Petrek | 206/443 |
| 6,474,481 | B1 * | 11/2002 | Liu | 211/69 |
| 6,808,077 | B2 * | 10/2004 | McConnell | 211/70.6 |
| 6,923,407 | B2 * | 8/2005 | Takeuchi | 248/73 |
| 7,258,239 | B2 * | 8/2007 | Kao | 211/70.6 |
| 7,424,958 | B1 * | 9/2008 | Eley | 211/70.6 |

* cited by examiner

*Primary Examiner* — Luan K Bui

(57) ABSTRACT

A tool positioning pad includes a pad having position holes opened therethrough. A plurality of position blocks is extruded from the pad. Each position block is located between each two diagonally adjacent position holes. At least one holder member is assembled onto the position holes of the pad. The holder member has a holder unit, a post unit and a plate unit. The holder unit is connected to one end of the post unit. The plate unit is connected to another end of the post unit. Two ends of the plate unit are extended from the post unit. Upon assembling, a user inserts the holder member into the position hole firstly; and then, the plate unit of the holder member is engaged with the bottom side of the pad by rotating the holder member, so as to assemble the holder member onto the pad.

7 Claims, 7 Drawing Sheets

TOOL POSITIONING PAD

CROSS-REFERENCE TO RELATED APPLICATION

This is a continuation-in-part of application Ser. No. 13/208,351, filed Aug. 12, 2011, now U.S. Pat. No. 8,371, 444.

BACKGROUND OF THE INVENTION

1. Field of the Invention

The present invention relates to a tool positioning pad, and more particularly to the tool positioning pad for positioning tool bits, handles and sockets.

2. Description of Related Art

The conventional tool positioning pad is disposed in a tool box and includes a plurality of position holes to position tool bits. Each position hole includes a position arm and a plurality of surfaces. A protrusion is formed at one end of each position arm for locking the tool bit. The plurality of surfaces fastens the tool bit stably. Therefore, the tool bit is positioned in each position hole, and the tool bit is locked by each protrusion for preventing the tool bit dropping out from the tool box.

However, the conventional tool positioning pad has no position holes for sockets and tool handles. A user may need a separate tool positioning pad for the sockets when the sockets are in need; and the user often needs another bag for receiving the handles when the handles are necessary. Therefore, the conventional tool positioning pad is inconvenient for the user and still needs to be improved.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved tool positioning pad.

To achieve the objective, a tool positioning pad comprises a pad and at least one holder member. The pad has a plurality of position holes uniformly opened therethrough. A plurality of position blocks is extruded from one side of the pad. Each position block is located between each two diagonally adjacent position holes. At least one holder member is assembled onto one of the position holes of the pad. The holder member has a holder unit, a post unit and a plate unit. The holder unit is connected to one end of the post unit. The plate unit is connected to another end of the post unit. Two ends of the plate unit are extended from the post unit so as to abut against a bottom of the pad. Wherein, each position hole has two position grooves respectively defined on two latitudinal side walls thereof; each position groove has a flat abutting surface horizontally formed thereon; the holder member has a flange formed between the holder unit and the post unit; the flange is corresponding to the position grooves; a bottom side of the flange is abutted against the flat abutting surface when the holder member is assembled into the position hole; a cross-section area of the flange is larger than a cross-section area of the post member; each position hole has at least one position protrusion defined on one of two longitudinal side walls thereof; the plate unit has at least one recess opened thereon; the recess is corresponding to the corresponding position protrusion; the holder unit of the holder member is formed as an elongated plate; the holder unit has a first surface and a second surface; the first surface is concaved toward the second surface so as to form a receiving space for receiving tools or tool accessories; the holder unit of the holder member is formed as cube-shaped; each position block of the pad further has a central protrusion and two side protrusions; the two side protrusions of each position block are respectively protruded from the central protrusion toward the two corresponding position holes which are diagonally adjacent to each other; the side protrusions are symmetrical to each other; and the position blocks are uniformly arranged.

Upon assembling, a user inserts the holder member into the position hole firstly; and then, the plate unit of the holder member is engaged with the bottom side of the pad by rotating the holder member, so as to assemble the holder member onto the pad.

Further benefits and advantages of the present invention will become apparent after a careful reading of the detailed description with appropriate reference to the accompanying drawings.

DETAILED DESCRIPTION OF THE INVENTION

Figure 1:
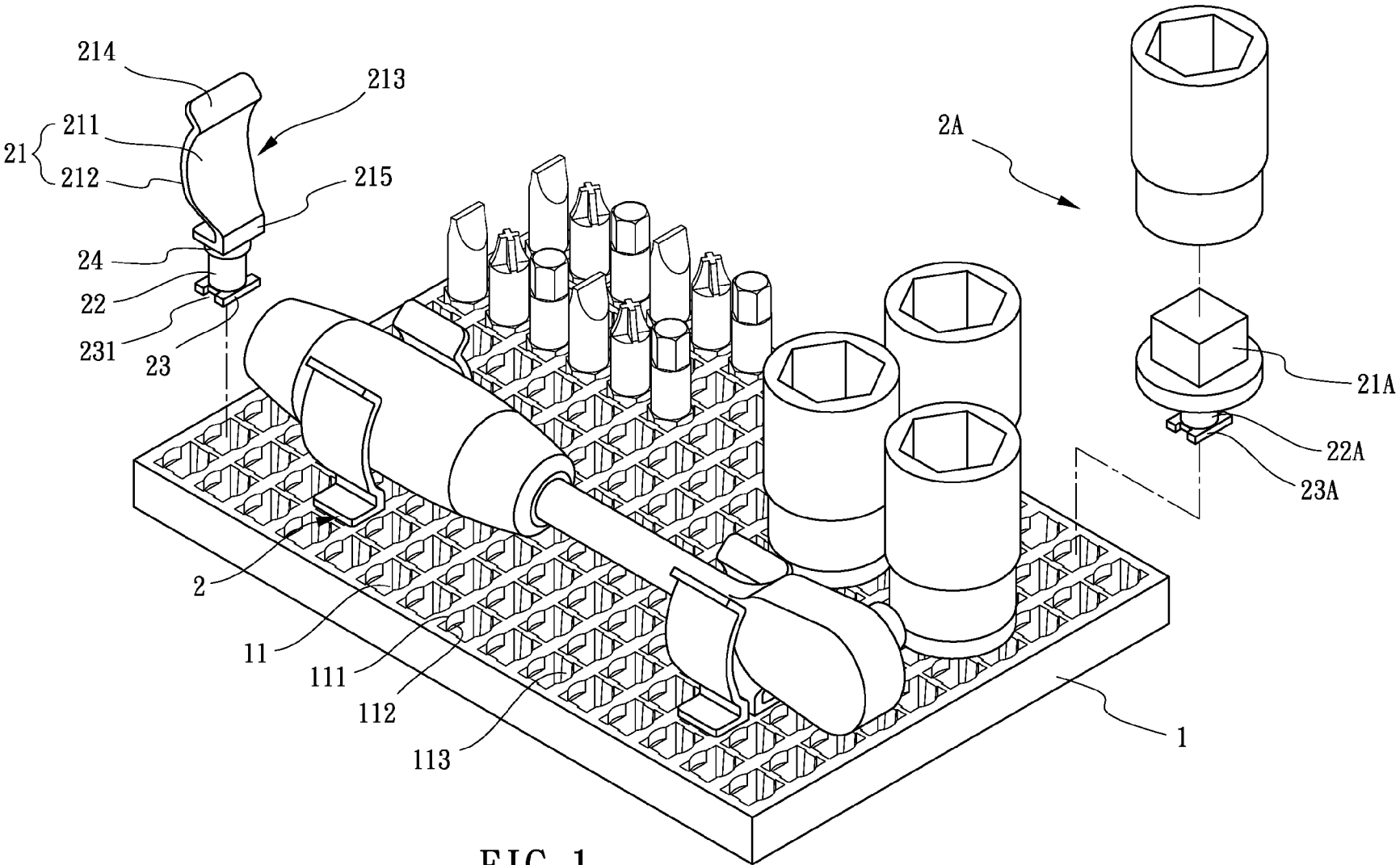
FIG. 1 is a partial exploded view of the present invention.

Referring to FIGS. 1-4, a tool positioning pad in accordance with the present invention comprises a pad 1 and at least one holder member 2. A plurality of position holes 11 is uniformly opened on the pad 1 therethrough. A plurality of position blocks 12 is extruded from one side of the pad 1. Each position block 12 is located between each two diagonally adjacent position holes 11. At least one holder member 2 is assembled onto one of the position holes 11 of the pad 1. The holder member 2 has a holder unit 21, a post unit 22 and a plate unit 23. The holder unit 21 is connected to one end of the post unit 22. The plate unit 23 is connected to another end of the post unit 22. Two ends of the plate unit 23 are extended from the post unit 22 so as to abut against a bottom side of the pad 1. Upon assembling, a user inserts the holder member 2 into the position hole 11 firstly; and then, the plate unit 23 of the holder member 2 is engaged with the bottom side of the pad 1 by rotating the holder member 2, so as to assemble the holder member 2 onto the pad 1.

Figure 2:
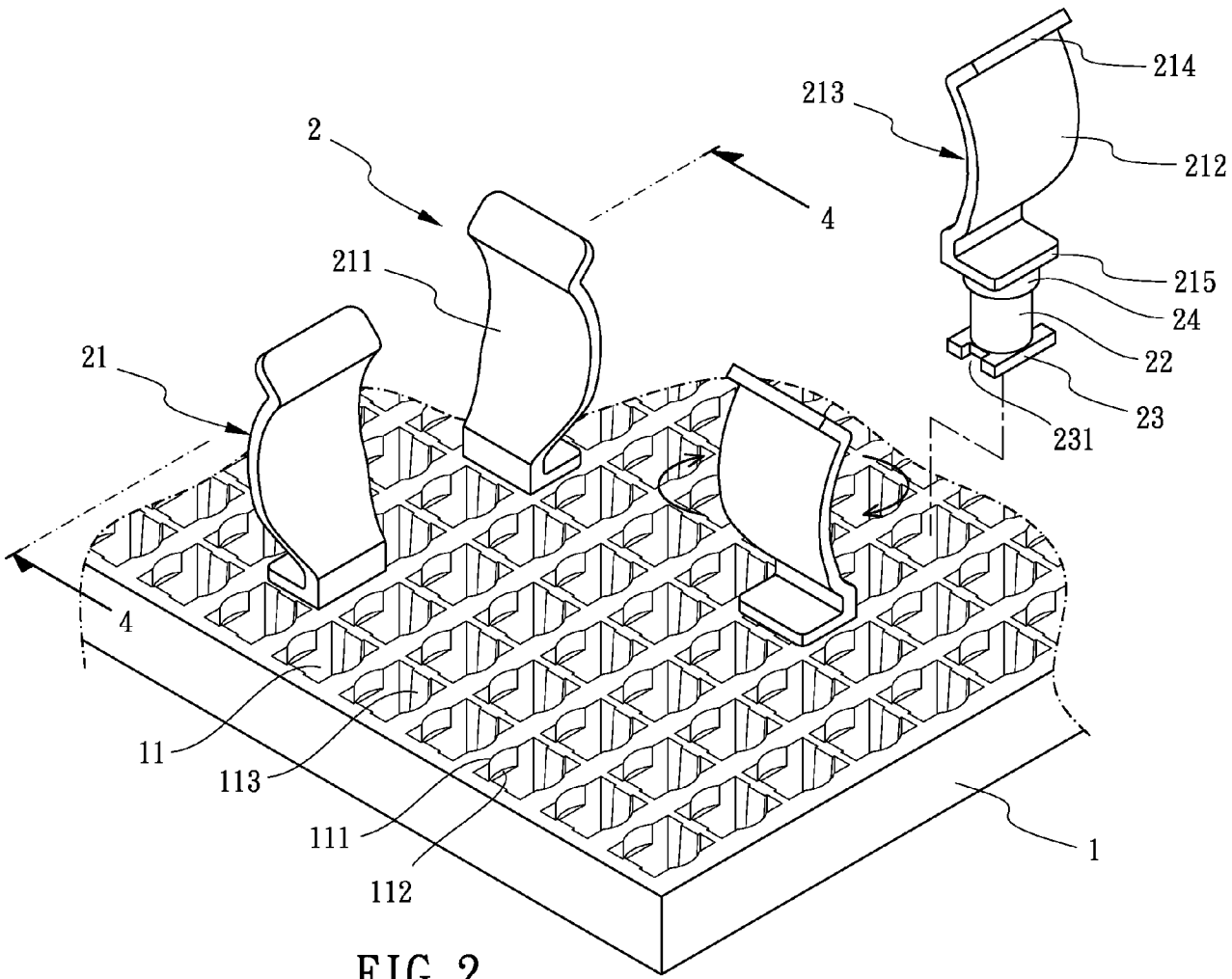
FIG. 2 is an enlarged upside-down exploded view of the present invention.
Figure 3:
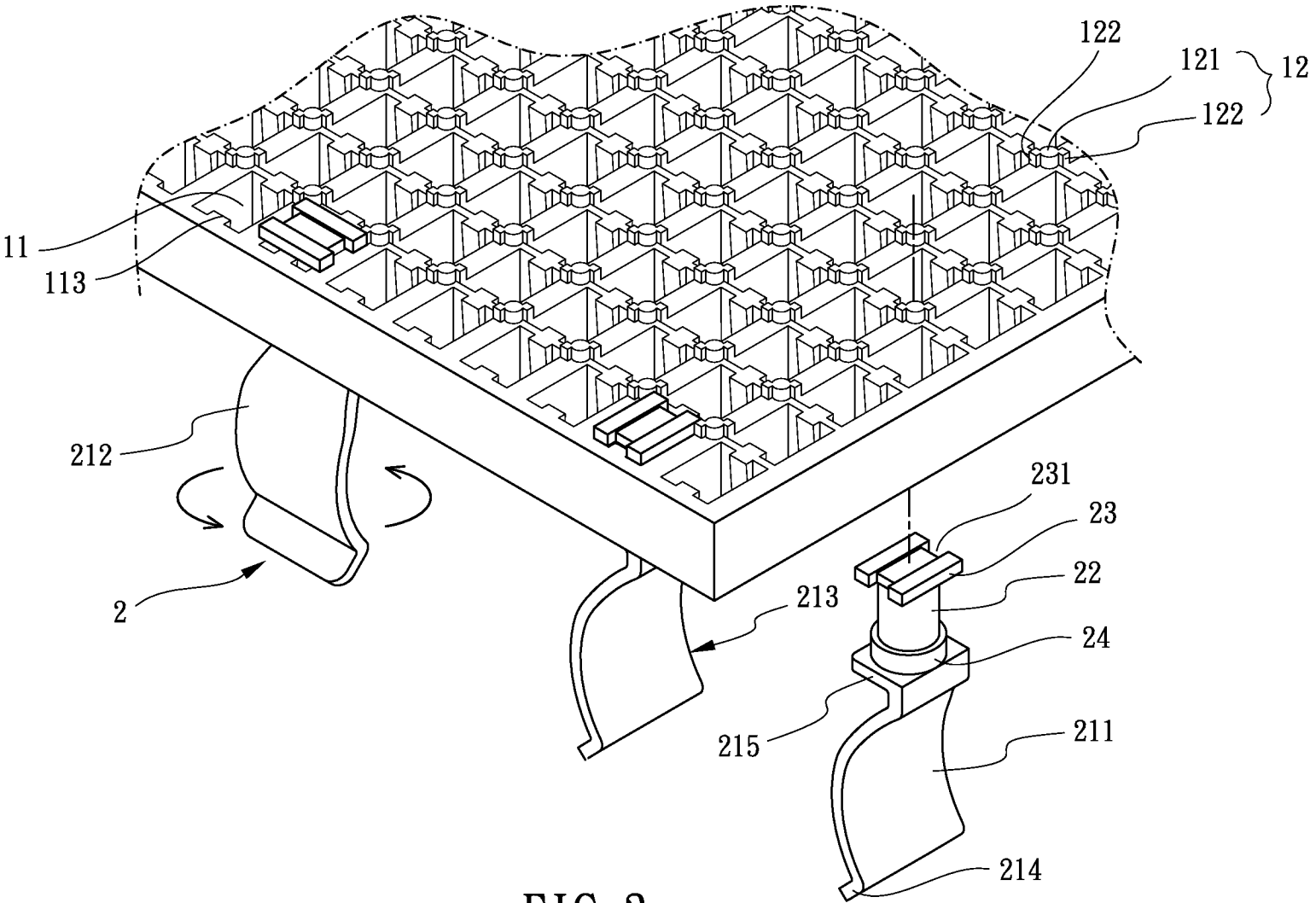
FIG. 3 is an enlarged assembled view for showing holder units are assembled on a pad of the present invention.
Figure 4:
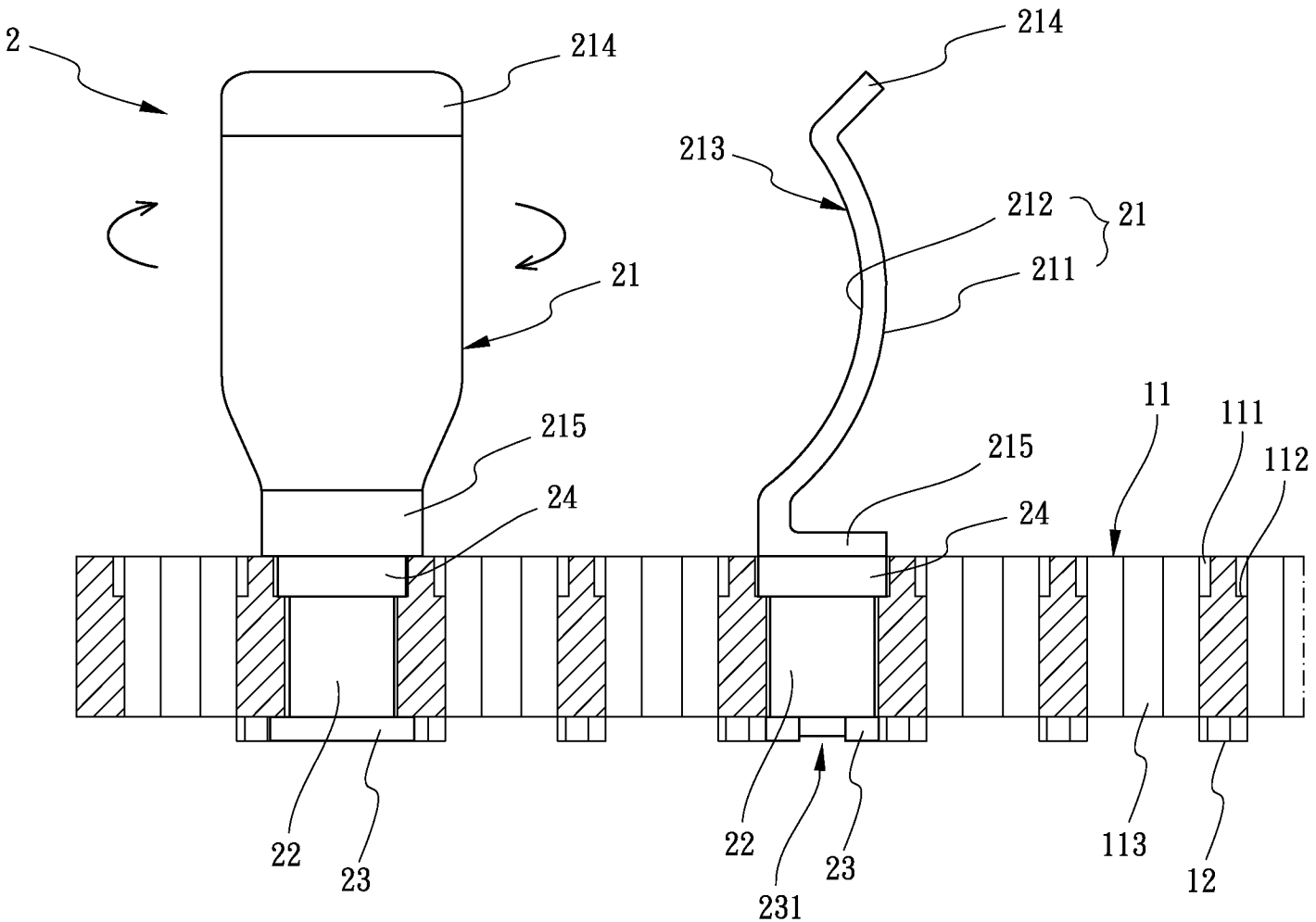
FIG. 4 is the cross-sectional view of the present invention along a line 4-4 shown in FIG. 3 for showing an open mode and a lock mode of the present invention.

Referring to FIGS. 2-4, the user can space the holder members 2 on the pad 1 so as to position tools or tool accessories, such as sockets, tool adapters, tool handles and screwdrivers on the pad 1. The plate unit 23 of the holder member 2 is inserted into the position hole 11 of the pad 1 so as to position the post unit 22 and the plate unit 23 into the position hole 11. The holder unit 21 is exposed from the position hole 11 of the pad 1 at a top side of the pad 1, and the holder member 2 is abutted against the pad 1. The position holes 11 and the plate units 23 of the holder members 2 are formed as rectangular-shaped; thereby, each position hole 11 and each plate unit 23 both have two long sides and two short sides. By rotating the holder unit 21 of the holder member 2, the holder member 2 is rotated; the plate unit 23 goes across the position hole 11, so that the two short sides of the plate unit 23 respectively overlap the two long sides of the position hole 11 and the two long sides of the plate unit 23 respectively face the two short sides of the position hole 11; therefore, the plate unit 23 of the holder member 2 is engaged with the position hole 11 by crossing the plate unit 23 and the position hole 11; in addition, to pivotally position the holder member 2 onto the pad 1, the plate unit 23 of the holder member 2 is further abutted against the position blocks 12 of the pad 1 after assembling. In this way, the holder member 2 is assembled onto the pad 1 securely and the tools or tool accessories can be positioned between the holder members 2. Therefore, the tool positioning pad is more convenient than the prior art since the tool positioning pad can not only position tool bits but also position other tools or tool accessories.

Referring to FIGS. 2-3, each position hole 11 has two position grooves 111 respectively defined on two latitudinal side walls thereof. Each position groove 111 has a flat abutting surface 112 horizontally formed thereon. The holder member 2 has a flange 24 formed between the holder unit 21 and the post unit 22. The flange 24 is formed as ring-shaped. A cross-section area of the flange 24 is larger than a cross-section area of the post member. The position groove 111 is corresponding to the flange 24. A bottom side of the flange 24 is abutted against the flat abutting surface 112 when the plate unit 23 of the holder member 2 is inserted into the position hole 11 of the pad 1. Therefore, when the holder member 2 is assembled onto the pad 1, the holder unit 21 of the holder member 2 is exposed from the position hole 11 of the pad 1, and the tools or tool accessories can be positioned between the holder members 2.

In order to identify a correspondence between the plate unit 23 and the position hole 11 when the user is inserting the plate unit 23 of the holder member 2 into the position hole 11 of the pad 1, each position hole 11 further has at least one position protrusion 113 defined on one of two longitudinal side walls thereof (in a preferred embodiment, each position hole 11 has two position protrusions 113 defined at the two longitudinal side walls thereof). The plate unit 23 has at least one recess 231 opened thereon. The recess 231 is corresponding to the corresponding position protrusion 113. By inlaying the position protrusion 113 into the recess 231, the plate unit 23 can be axially moved along the position hole 11; as a result, the holder member 2 is assembled onto the pad 1. Besides, a thickness of each position protrusion 113 is gradually increased from a top to a bottom thereof, so as to make an insertion of the plate unit 23 of the holder member 2 stable, when the plate unit 23 of the holder member 2 is being inserted into the position hole 11 of the pad 1.

Furthermore, each position block 12 of the pad 1 further has a central protrusion 121 and two side protrusions 122. The two side protrusions 122 of each position block 12 are respectively protruded from the central protrusion 121 toward the two corresponding position holes 11 which are diagonally adjacent to each other. The side protrusions 122 are symmetrical to each other. The position blocks 12 are uniformly arranged. After the plate unit 23 is inserted into the position holes 11, the holder member 2 can be rotated in one direction until the position block 12 abuts against the plate unit 23 of the holder member 2; in addition, after the plate unit 23 is inserted into the position holes 11, the position block 12 is also used to abut against the plate unit 23 of the holder member 2 if the holder member 2 is rotated in another direction. Therefore, after the user inserts the plate unit 23 of the holder member 2 into the position hole 11 of the pad 1, the holder member 2 can only be rotated in one direction because of the position block 12; and the holder member 2 is pivotally positioned via the position blocks 12 after assembling. In addition, when the holder member 2 is assembled on the pad 1, the user can rotate the holder member 2 in another direction until the position block 12 abuts against the plate unit 23 of the holder member 2, so as to disassemble the holder member 2 from the pad 1.

Referring to FIGS. 1-4, the holder unit 21 of the holder member 2 has two embodiments so as to position different types of the tools or tools accessories. In one embodiment, the holder unit 21 of the holder member 2 is formed as an elongated plate. The holder unit has a first surface 211 and a second surface 212. The first surface 211 is concaved toward the second surface 212 so as to form a receiving space 213 for receiving the tools or tool accessories. When the user wants to position the tools, such as handles on the pad 1, the user assembles two holder members 2 onto the pad 1; as a result, the first surface 211 of one holder member 2 faces the first surface 211 of another holder member 2, so as to form the receiving space 213 for clamping the handles. The user can space different amount of the holder members 2 on the pad 1 based on a length of the tools or tool accessories. The holder unit 21 further has a top plate 214 and a bottom plate 215 extended from a top and a bottom thereof respectively. The top plate 214 of the holder unit 21 is extended toward an outer side relative to the holder unit 21. The bottom plate 215 of the holder unit 21 is extended downwardly, and then is vertically bent toward the outer side relative to the holder unit 21. The top plate 214 protects the user from scratching by the holder member 2 when taking the tools or tool accessories positioned between the holder members 2. The bottom plate 215 provides elasticity for the holder unit 21, so that the receiving space 213 is capable of clamping the tools or tool accessories with larger size. In another embodiment as shown in FIG. 1, at least one holder member 2A is assembled onto one of the position holes 11 of the pad 1. The holder member 2A has a holder unit 21A, a post unit 22A, a plate unit 23A, and a flange (not shown). The holder unit 21A is connected to one end of the post unit 22A. The plate unit 23A is connected to another end of the post unit 22A. Two ends of the plate unit 23A are extended from the post unit 22A so as to abut against the bottom side of the pad 1. The flange is formed between the holder unit 21A and the post unit 22A. The flange is corresponding to the position grooves 111. The holder unit 21A of the holder member 2A is formed as cube-shaped so that the user can fitly insert the holder unit 21A into the tools or tool accessories, such as sockets, so as to securely position the tools or tool accessories onto the pad 1.

Figure 5:
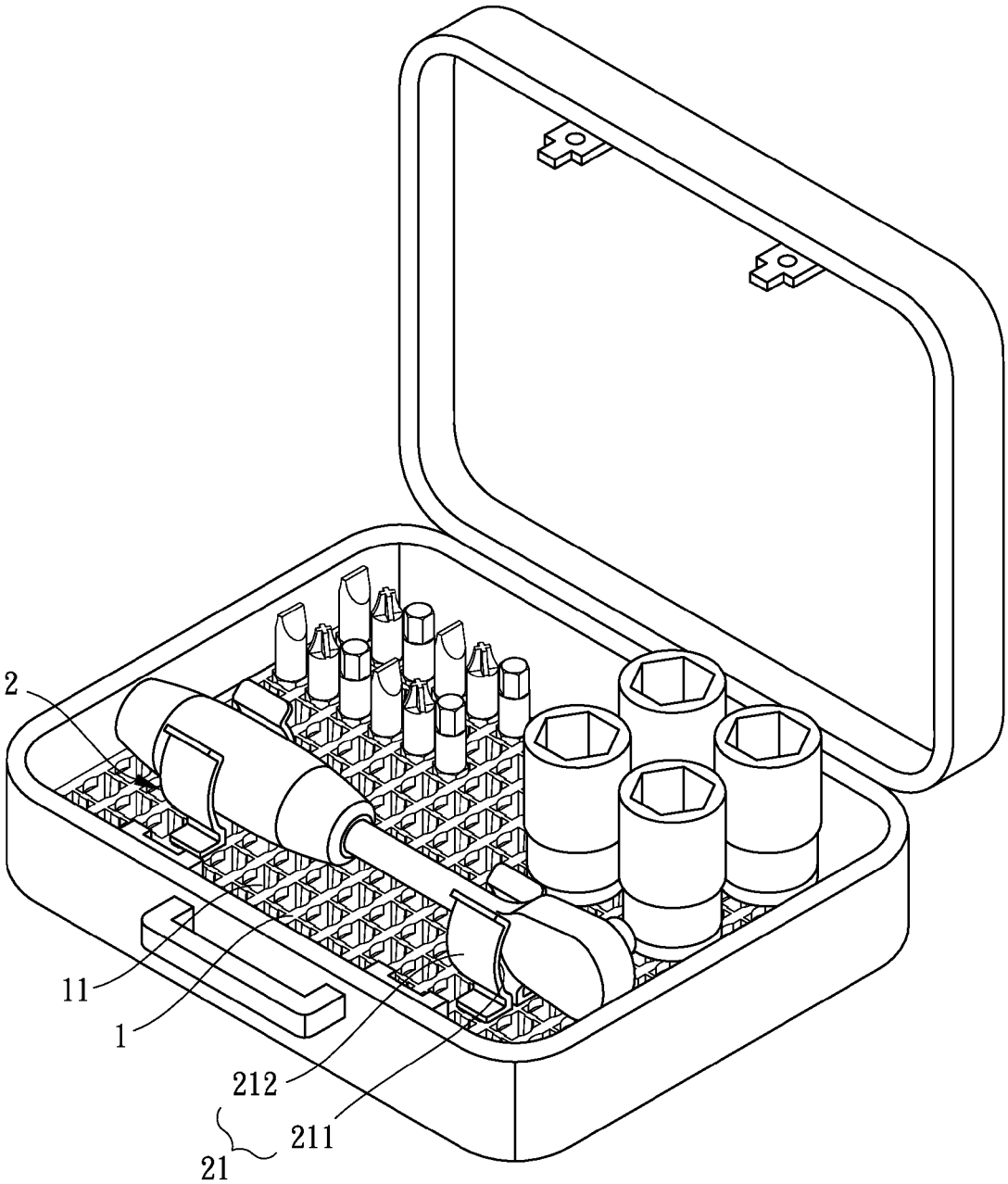
FIG. 5 is a perspective view for showing the embodiment of the present invention is assembled with a tool box.
Figure 6:
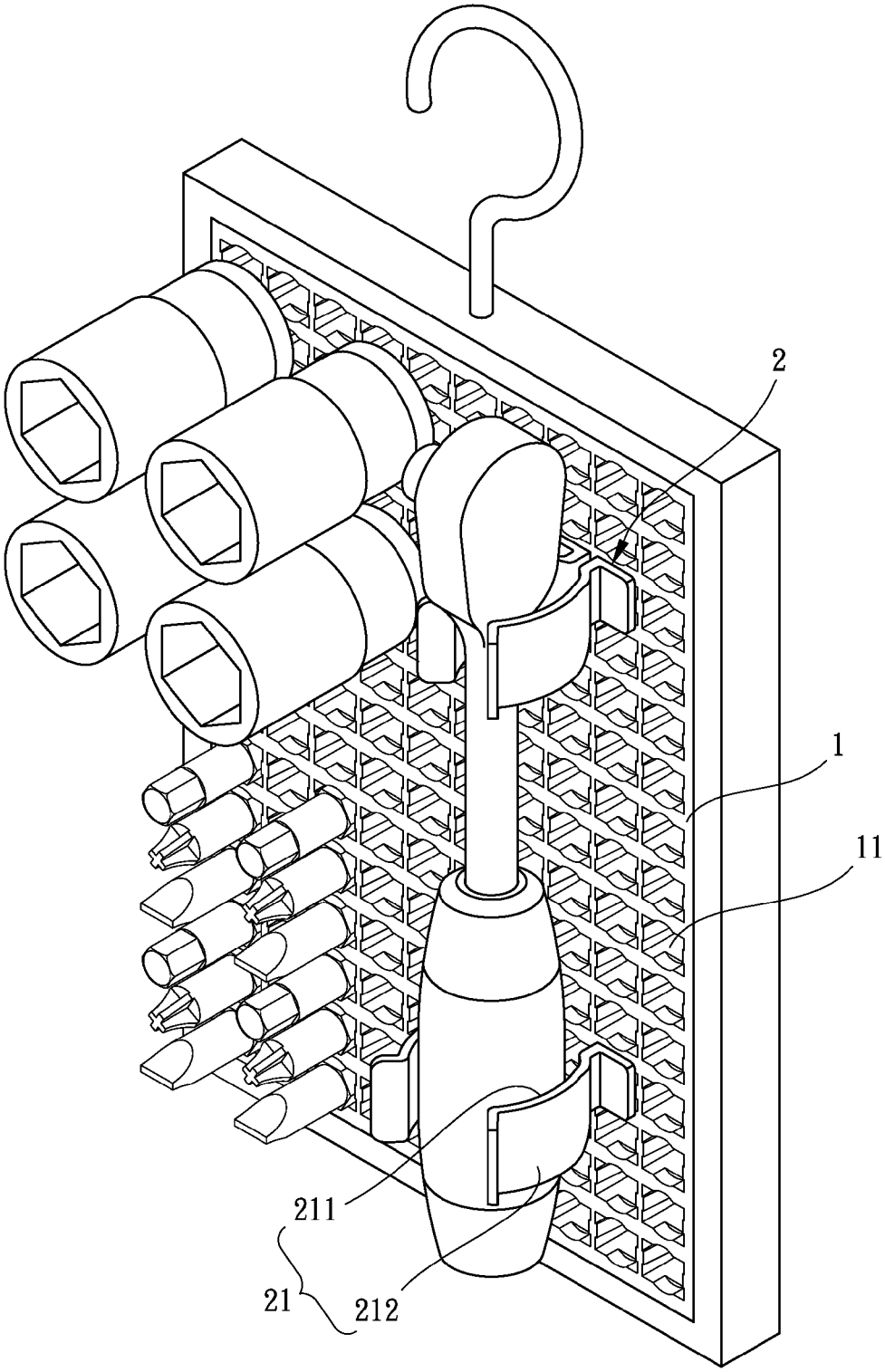
FIG. 6 is a perspective view for showing the embodiment of the present invention is assembled with a tool positioning hanger.
Figure 7:
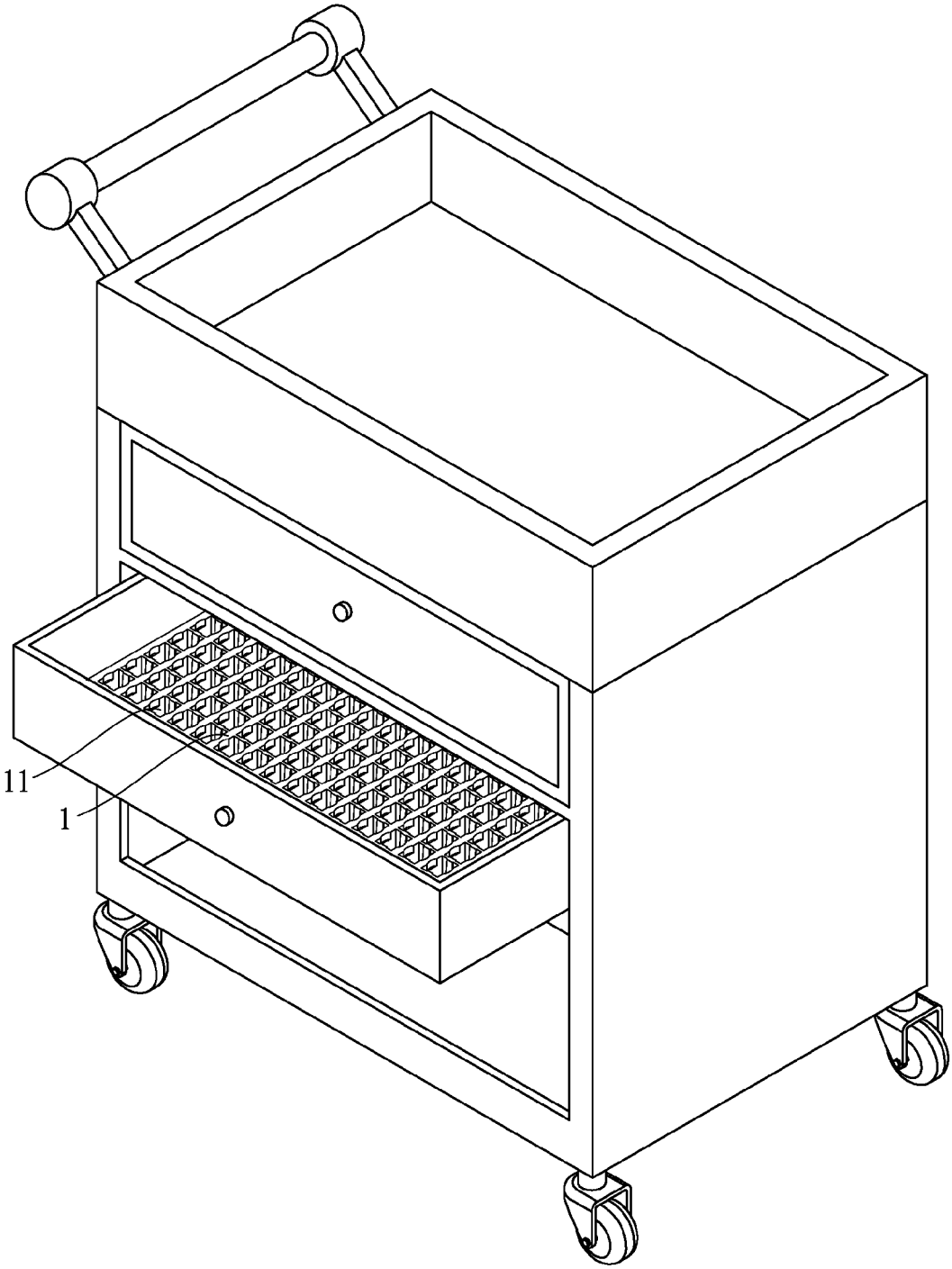
FIG. 7 is a perspective view for showing the embodiment of the present invention is assembled with a tool cart.

Referring to FIGS. 5-7, the tool positioning pad is attachable to other articles, such as a tool box, a tool positioning hanger or a tool cart.

Although the invention has been explained in relation to its preferred embodiment, it is to be understood that many other possible modifications and variations can be made without departing from the spirit and scope of the invention as hereinafter claimed.

What is claimed is:

1. A tool positioning pad comprising:

a pad having a plurality of position holes uniformly opened therethrough, a plurality of position blocks extruded from one side of the pad, each position block located between each two diagonally adjacent position holes; and at least one holder member assembled onto one of the position holes of the pad, the holder member having a holder unit, a post unit and a plate unit, the holder unit connected to one end of the post unit, the plate unit connected to another end of the post unit, two ends of the plate unit extended from the post unit;

wherein once the holder member is inserted in the respective position hole of the pad and rotated with respect to the pad by an angle in a direction to have the plate unit of the holder member so as to abut against a bottom side of the pad, the two ends of the plate unit are blocked by at least one of the position blocks from further rotation in the same direction.

2. The tool positioning pad as claimed in claim 1, wherein each position hole has two position grooves respectively defined on two latitudinal side walls thereof; each position groove has a flat abutting surface horizontally formed thereon; the holder member has a flange formed between the holder unit and the post unit; the flange is corresponding to the position grooves; and a bottom side of the flange is abutted against the flat abutting surface when the holder member is assembled into the position hole.

3. The tool positioning pad as claimed in claim 2, wherein a cross-section area of the flange is larger than a cross-section area of the post member.

4. The tool positioning pad as claimed in claim 2, wherein each position hole has at least one position protrusion defined on one of two longitudinal side walls thereof; the plate unit has at least one recess opened thereon; and the recess is corresponding to the corresponding position protrusion.

5. The tool positioning pad as claimed in claim 1, wherein the holder unit of the holder member is formed as an elongated plate; the holder unit has a first surface and a second surface; and the first surface is concaved toward the second surface so as to form a receiving space for receiving tools or tool accessories.

6. The tool positioning pad as claimed in claim 1, wherein the holder unit of the holder member is formed as cube-shaped.

7. The tool positioning pad as claimed in claim 1, wherein each position block of the pad further has a central protrusion and two side protrusions; the two side protrusions of each position block are respectively protruded from the central protrusion toward the two corresponding position holes which are diagonally adjacent to each other; the side protrusions are symmetrical to each other; and the position blocks are uniformly arranged.

* * * * *